United States Patent [19]

Lerner

[11] 4,379,696

[45] Apr. 12, 1983

[54] LATEX MYLAR CHIP

[75] Inventor: Stanley Lerner, Highland Park, Ill.

[73] Assignee: Color Communications, Inc., Chicago, Ill.

[21] Appl. No.: 233,843

[22] Filed: Feb. 12, 1981

[51] Int. Cl.[3] ..... G09F 7/00; A44B 7/00

[52] U.S. Cl. ..... 434/98; 40/492; 206/81; 206/472; 428/337; 428/339

[58] Field of Search ..... 434/84, 98, 99, 100; 40/492; 428/328, 337, 339, 480; 206/81, 472

[56] References Cited

U.S. PATENT DOCUMENTS

| | | | |
|---|---|---|---|
| 3,043,710 | 7/1962 | Patten et al. | 428/480 |
| 3,224,113 | 12/1965 | Goldsholl | 434/98 |
| 3,234,038 | 2/1966 | Stephens et al. | 428/328 |
| 3,312,563 | 4/1967 | Rusch | 428/480 |
| 3,434,227 | 3/1969 | Brown, Jr. | 434/98 |
| 4,061,521 | 12/1977 | Lerner et al. | 156/265 |
| 4,104,809 | 8/1978 | Day et al. | 434/104 |
| 4,146,031 | 3/1979 | Fujiyama et al | 428/328 |

OTHER PUBLICATIONS

P. 180 of vol. 4 of Encyclopedia of Chemical Technology, Interscience Publishers, Inc., Copyright 1949.

*Primary Examiner*—William R. Dixon, Jr.

*Attorney, Agent, or Firm*—Fitch, Even, Tabin, Flannery & Welsh

[57] ABSTRACT

A paint display product is disclosed which comprises a Mylar film base which will provide a high gloss finish to the paint when viewed through the base to the paint.

12 Claims, 3 Drawing Figures

LATEX MYLAR CHIP

The present invention relates to color sample display products for paints including paints having an aqueous phase and where such products include color sample paint chips or swatches. Such chips or swatches are generally affixed to and are displayed on paper cards, mounts or the like wherein each chip or swatch is coated with a different color or tone thereof so that a consumer may order a particular paint or color after making a visual selection from the array of colored chips on the card.

The development of emulsion paints has been rapid and remarkable. Emulsion paints generally consist of two liquid phases one of which is water and one phase is in small droplets dispersed in a continuous phase. In latex paints, however, the dispersed phase is a plastic semisolid forming an emulsion in water. These paints are easy to apply. They may be thinned with water, and brushes or coaters may be cleaned with soap and water. Generally, there is no unpleasant odor and there is little or no risk of fire or explosion as a result of use of volatile solvents.

The fact that the continuous phase of emulsion and latex paints is water lends to their advantages, but also creates a problem with respect to their marketing and display, and creates a limitation with respect to the surfaces to which they can be applied. Paints are usually marketed or displayed to the consumer through color chip or colored swatch bearing sheets. These sheets are paper having color chips adhesively affixed thereon. These color chips are paper coated with paint which are adhesively attached in display fashion to the bearing sheet with indicia identifying the color of each chip. Applying paint containing substantial amounts of water to paper, however, has not been successful because the water causes the paper to rumple or buckle. This phenomenon is the antithesis of the purpose of the display and marketing of paints in an attractive fashion.

It is known that when using paint that is a latex or emulsion with water as the continuous phase, the paper to be painted has to be sized to seal the pores in the paper against the water in the paint. This is not only time consuming, but does not entirely prevent the paper from absorbing water.

Another problem in the marketing and display of paints occurs with metallic finishes. Paint with metallic finishes have become very popular especially in the automobile industry. These popular paints have aluminum flake pigments which are not compatable with popular water emulsion paint systems, and have not had a water phase. Heretofore, mixing aluminum flake pigments into water emulsion paints caused a reaction giving rise to gases with the reaction being potentially explosive. Further, even if the aluminum flake pigment was successfully mixed into the water emulsion paint, the metallic chips or flakes in the paint to create the metallic finish had a tendency to settle in the paint. This settling has a tendency to create a swirl pattern when the paint is applied. Latex metallic paint which does not permit the aluminum paint to settle, provides the advantage of popular latex paints and a means for the display such paints is needed.

Another problem exists in displaying paint attractively such that it has a gloss for aesthetic or communicative purposes. A need exists, therefore, for a material which will not rumple or crumple when painted with paints containing water such as emulsion or latex paints. A need exists for a medium which permits the display of paint with the appearance of high gloss.

In accordance with the present invention, it has been found that Mylar film may be coated with an emulsion or latex paint wherein the continuous phase is water without the rumpling or buckling of the painted surface. According to another aspect of the present invention, metallic finishes may be applied to Mylar film using latex paint with a water phase having compatability with the metallic pigments wherein the metallic paint may be applied without undesirable swirl patterns. Further, Mylar film painted in accordance with the invention provides a high gloss finish when viewed from the non-painted side of the Mylar. Hence, Mylar film provides an ideal medium for a base for painted color chips or swatches which will not rumple or crumple when a latex or emulsion paint with a water continuous phase is applied. Mylar, however, not only provides an ideal base for color chips, but the invention also provides a heretofore unknown use of Mylar film as a base for metallic paints or any paint wherein it is desired to have a high gloss for such paints.

Accordingly, an object of the present invention is to provide a base for latex or emulsion paints with a water phase.

Another object of the present invention is to provide a base for latex or emulsion paints with a water phase wherein such base will not rumple or crumple when painted and exposed to the water in the paint.

Still another object of the present invention is to provide a paint display product base for water emulsion paint with a metallic finish.

Another object of the invention is to provide a base for any paint which will provide a high gloss finish to the paint when viewed through the base to the paint.

Other objects and advantages of the invention will become apparent from the following detailed description taken in connection with the accompanying drawings in which.

Figure 1:
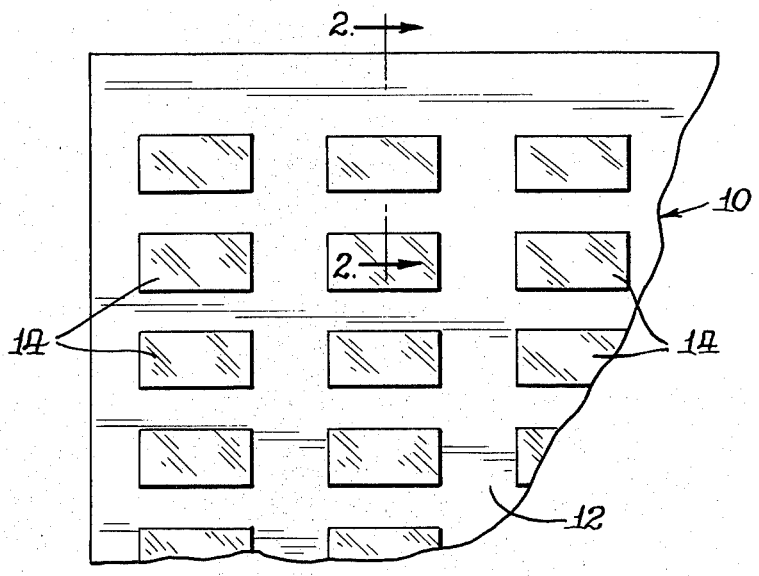
FIG. 1 is a plan view of a color display sheet in accordance with the present invention, the display chips being shown adhesively fixed on the sheet in rows.

Referring now to FIG. 1 of the drawings, a display card 10 is comprised of a base mount 12 which is a paper card or the like with a plurality of color chips 14 affixed thereon by means of an adhesive or the like. Although the mount card is shown with a plurality of chips thereon, the mount card may be used to display only one color chip or color per mount card as in U.S. Pat. No. 4,104,809 to Day et al. The mount card may be made of any suitable material to which Mylar film may be affixed.

Figure 2:
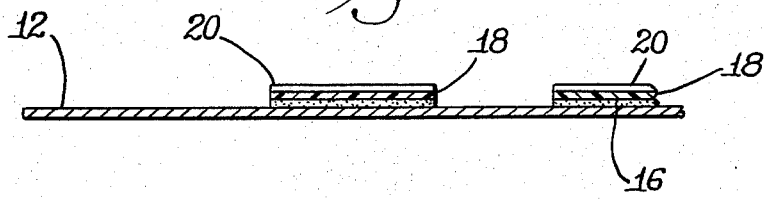
FIG. 2 is a side elevational view of the display sheet along line 2—2 of FIG. 1.

According to the invention, the color chips 14 have a base of Mylar, which is a registered trademark of the E. I. duPont deNemours & Co. for a transparent film of polyethylene terephthalate resin which has a thickness range from about 0.00025 inches to about 0.0075 inches. In the invention, the preferred range for the thickness of the film is from about ½ mil to about 7 mils. Referring to FIG. 2, the Mylar base 18 is coated with paint such as a latex or emulsion paint 20. The coating of the Mylar may be by the use of a knife over roll coating operation in a web as is known in the art. After coating the Mylar with paint the coated Mylar is cut into strips, and the strips cut into swatches which are affixed to the paper mount card by means of adhesive 16. U.S. Pat. No. 4,061,521 to Lerner et al., assigned to Color Communications, Inc., discloses a method and apparatus for the manufacture of swatch bearing sheets such patent being incorporated by reference as if fully rewritten herein. It is preferable to use the latter method and apparatus when using Mylar with a thickness of about 3 mils or less.

For display of the paint and its finish, the painted surface 20 of the Mylar is opposite the side of the Mylar which is adhesively fixed to the paper card. The paint also may be displayed with a high gloss finish when the chip is affixed to the mount card with the unpainted Mylar facing away from the card. When displaying latex paints as color chips on cards, good blockability and a high Tg, the temperature at which the paint will form an external film, are advantageous, but not required.

Figure 3:
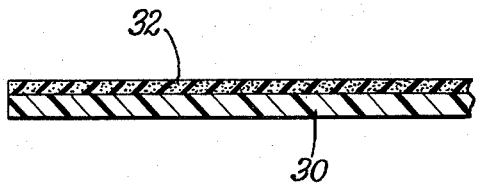
FIG. 3 is a side view of an alternate embodiment of the invention wherein the base Mylar sheet is used with metallic paint.

In an alternate embodiment of the invention as shown in FIG. 3, a Mylar base is used in conjunction with paints having a metallic finish. With respect to the use of the invention with paint having a metallic finish, it is critical that when the paint is a water emulsion system, the water emulsion system of the paint be compatable with non-leafing aluminum flake pigments commonly found in metallic paint, and also be compatable with tinting pigments which are used with metallic paint. A water-latex emulsion having high gloss, good block resistance when applied so that the paint chip surfaces will not stick to one another, and a relatively high temperature (Tg) at which a water-latex emulsion will form a film with external coalescence are all required of the water-latex emulsion used in the metallic latex paint or emulsion system of the invention. The Tg for the water-latex emulsion used in making the latex metallic paint of the invention should be in the range of from about 25° to about 100° C. The methylmethacrylate-butylmethacrylate copolymer water-latex emulsion E-1630 sold by the Rohm and Haas Co., Philadelphia, Pa. has high gloss, good block resistance and a Tg of 50° C., a solids content of from about 44.5% to about 45.5% by weight and a specific gravity of 1.035. The latter water-latex emulsion is compatible with non-leafing aluminum flake pigments and will provide an ideal metallic latex paint when combined with a dispersent or dispersing agent forming from about 0.5 to about 1.5% by weight of the emulsion system; a non-ionic surfactant forming from about 0.2 to about 0.8% by weight of the emulsion system; a defoamer forming from about 0.25 to about 0.75% by weight of the emulsion system; a coalescent forming from about 2.5 to about 4.5% by weight of the emulsion system; an alkaline activator such as dimethylamino ethanol or ammonia to adjust the pH of the emulsion system to within a range from about 8.8 to about 10, wherein the alkaline agent generally forms about 0.4% by weight of the emulsion system; non-leafing aluminum flake pigment having a size of from about 150 mesh to about 400 mesh forming from about 5 to about 25% by weight of the emulsion system; and water as is necessary to bring the emulsion to 100% wherein the E-1630 water-latex emulsion forms from about 40 to 60% by weight of the emulsion system. The dispersent such as Tamol 731 (which is a product of Rohm and Haas Co.), or others as are known in the art, reduces the tendency of the pigments to agglomerate. The surfactant such as Triton GR-7, Triton CF-10 (which are products of the Rohm and Haas Co.), or others as are known in the art, provides color and pigment stability. The coalescent, such as Texanol (whch is a C12 ester alcohol and product of the Eastman Kodak Company), butyl benzoate, dimethyl adipate, or others as are known in the art, promotes the coalescence of the particles of the emulsion into a paint film. The defoamer such as Foam Master DS and AP defoamer (which are products of the Diamond Shamrock Company, Dallas, Tex.) or others as are generally known in the art, reduce the amount of air or foam in the emulsion paint. Other additives may optionally be added to the emulsion system such as a solvent selected from the group consisting of methylcarbitol, ethylene glycol, propylene glycol and mixtures thereof forming from about 2½ to about 4½% by weight of the total emulsion system; tinting pigments, as are known in the art, forming from 0 to about 5% of the emulsion system; preservatives, as are known in the art, forming about 0.25% by weight of the emulsion system; and thickeners forming about 2 to about 4% by weight of the emulsion system, such as RM-5 (which is an acrylic copolymer product from the Rohn and Hass Co.), hydroxyethylcellulose, carboxymethylcellulose, or others as are known in the art. The methyl carbitol solvent controls the speed of drying with fast drying being desired.

The order of mixing the components of the metallic latex paint of the invention is very important. The solvent, such as methyl carbitol, and the water-latex emulsion comprising the methylmethacrylate-butylmethacrylate copolymer, such as E-1630, are mixed to form a homogeneous first mixture. The dispersent, the surfactant, defoamer, coalescent, and preservative are mixed separately to a homogeneous second mixture which is then homogeneously mixed with the first mixture to form a third mixture. The alkaline agent, thickener and water are homogeneously mixed to form a fourth mixture which is then homogeneously mixed with the third mixture to form a fifth mixture. Aluminum pigment flakes are slowly added to the fifth mixture. The flakes must be carefully and slowly added to avoid the formation of gas and a possible explosion as a result of their addition to the water-emulsion system. The latter final mixture is aged by permitting it to stand for 24 hours before it is applied to the Mylar base of the invention.

For a clearer understanding of the invention with respect to metallic latex paint, the specific example is set forth below. This example is merely illustrative and is not understood as limiting the scope of the invention in any way.

EXAMPLE I

Forty pounds of methyl carbitol and 525 pounds of E-1630 latex emulsion from the Rohm and Hass Co. are homogeneously mixed.

In a separate vessel, 7.9 pounds of Tamol 731 which is a dispersent and a product of the Rohm and Hass Co., 1.8 pounds of Triton CF10 and 2.0 pounds of Triton GR7 which are surfactants and products of the Rohm and Hass Co., 2.5 pounds of Foam Master DS, 35.4 pounds of texanol, and 1.3 pounds of Dowicil 75 which is a preservative and product of the Dow Chemical Company, are homogeneously mixed with the methyl carbitol and E-1630 mixture.

4.3 pounds of dimethylamino ethanol, and 23.6 pounds of Acrysol RM-5 are added to and homogeneously mixed with 206.2 pounds of water. The latter water mixture is then added to and homogeneously mixed into the E-1630-dispersent-surfactant mixture. Finally, 150 pounds of 150 mesh non-leafing aluminum flake pigment from Crescent Bronze Powder Company of Chicago, Ill. (designated as No. 242 flakes) is slowly and carefully added to and mixed with the latter water emulsion to form the metallic latex paint of the invention. The latter metallic latex paint is then permitted to age or set for at least 24 hours before it is applied to a Mylar base as previously described.

While a preferred embodiment of the invention has been shown and described for use as color chips on display cards, Mylar which is coated with latex or emulsion paint may be used in conjunction with any appropriate color display product. Further, the glossy surface of Mylar coated with any paint including latex or emulsion paint may be used in conjunction with gift wrapping decoration, safety, or with other products where color is appropriate for an aesthetic or communicative purpose. The preferred embodiments as shown and described therefore, are intended to cover all modifications and constructions falling within the spirit and scope of the invention as defined in the appended claims.

What is claimed is:

1. A color sample display device capable of being produced with an automated apparatus, said display device comprising a plurality of color swatches consisting essentially of polyethylene terephthalate film having a thickness of from about ½ mil to about 7 mils, a paint coating on the surface of said film;

an adhesive on said coating or unpainted surface of said film; and a base sheet with said color swatched adhesively affixed thereto.

2. A color sample display device as recited in claim 1 wherein said paint coating is derived from a water base paint.

3. A color sample display device as recited in claim 2 wherein said paint coating is selected from the group comprising latex paint, emulsion paint, and mixtures thereof.

4. A color sample display device as recited in claims 1, 2, or 3 wherein said adhesive is on said unpainted surface of said film.

5. A color display product capable of being produced with an automated apparatus said display product consisting essentially of a polyethylene terephthalate film base with a thickness of from about ½ mil to about 7 mils;

a paint coating on one surface of said film base;

an adhesive coating; and a mount base, said film base being adhesively affixed to said mount base with said adhesive coating being on said painted coating or on said unpainted surface of said film base.

6. A color display product as recited in claim 5 wherein said paint coating is derived from a water base paint.

7. A color display product as recited in claim 6 wherein said paint coating is selected from the group comprising latex paint, emulsion paint, and mixtures thereof.

8. A color display product as recited in claim 7 wherein said paint coating is a metallic latex paint.

9. A color display product as recited in claim 5 wherein said mount base has a plurality of swatches adhesively affixed thereto, said swatches comprising said painted film base.

10. A color display product as recited in claim 9 wherein said adhesive coating is on said unpainted surface of said film base.

11. An automated method for making a color sample display device comprising:

providing a sheet of polyethylene terephthalate having a thickness from about ½ mil to about 7 mils;

coating one surface of said sheet with a paint coating;

coating the painted coating or unpainted surface of said sheet with an adhesive; and adhesively affixing said sheet to a base sheet.

12. A color display product comprising a plurality of color swatches consisting essentially of a polyethylene terephthalate film base with a thickness of from about ½ mil to about 7 mils;

a paint coating on one surface of said film base;

an adhesive coating; and a mount base, said film base being adhesively affixed to said mount base with said adhesive coating being on said painted coating.

* * * * *

REEXAMINATION CERTIFICATE (1404th)

United States Patent [19]

Lerner

[11] B1 4,379,696

[45] Certificate Issued Jan. 15, 1991

[54] LATEX MYLAR CHIP

[75] Inventor: Stanley Lerner, Highland Park, Ill.

[73] Assignee: Color Communications, Inc., Chicago, Ill.

Reexamination Request:
No. 90/001,658, Dec. 1, 1988

Reexamination Certificate for:

| | |
|---|---|
| Patent No.: | **4,379,696** |
| Issued: | **Apr. 12, 1983** |
| Appl. No.: | **233,843** |
| Filed: | **Feb. 12, 1981** |

[51] Int. Cl.[5] ..... G09F 7/00; A44B 7/00

[52] U.S. Cl. ..... 434/98; 206/81; 434/337

[58] Field of Search ..... 428/46, 47, 78, 203, 428/204, 320, 337, 339, 480; 434/84, 89, 99, 100; 40/492; 206/81, 472

[56] References Cited

U.S. PATENT DOCUMENTS

| | | | |
|---|---|---|---|
| 2,751,316 | 6/1956 | Phillips | 117/138.8 |
| 2,786,778 | 3/1957 | Palmquist | 117/12 |
| 2,836,528 | 5/1958 | Ford | 154/49 |
| 3,043,710 | 7/1962 | Patten et al. | 117/33.5 |
| 3,048,564 | 8/1962 | Heffelfinger | 260/75 |
| 3,158,494 | 11/1964 | Eikvar et al. | 117/45 |
| 3,224,113 | 12/1965 | Goldsholl | 35/28.3 |
| 3,234,038 | 2/1966 | Stephens et al. | 117/71 |
| 3,300,435 | 1/1967 | Ueda et al. | 260/30.4 |
| 3,312,563 | 4/1967 | Rusch | 117/33.3 |
| 3,322,605 | 5/1967 | Frech | 161/6 |
| 3,335,029 | 8/1967 | Holben | 117/138.8 |
| 3,434,227 | 3/1969 | Brown | 35/28.3 |
| 3,452,464 | 7/1967 | Robinson | 40/134 |
| 3,511,213 | 5/1970 | Reed et al. | 118/401 |
| 3,627,579 | 12/1971 | Heffelfinger | 117/236 |
| 3,967,009 | 6/1976 | Blake | 427/256 |
| 4,061,521 | 12/1977 | Lerner et al. | 156/265 |
| 4,082,873 | 4/1978 | Williams | 428/40 |
| 4,104,809 | 8/1978 | Day et al. | 35/28.5 |
| 4,146,031 | 3/1979 | Fujiyama et al. | 428/323 |
| 4,264,657 | 4/1981 | Tollette | 428/35 |
| 4,273,816 | 6/1981 | Tollette | 428/35 |

FOREIGN PATENT DOCUMENTS

| | | |
|---|---|---|
| 720868 | 12/1954 | United Kingdom . |
| 730099 | 5/1955 | United Kingdom . |
| 730100 | 5/1955 | United Kingdom . |
| 738866 | 10/1955 | United Kingdom . |
| 788365 | 1/1958 | United Kingdom . |
| 796341 | 6/1958 | United Kingdom . |
| 1232971 | 5/1971 | United Kingdom . |
| 1265810 | 3/1972 | United Kingdom . |
| 1295634 | 11/1972 | United Kingdom . |
| 1469437 | 4/1977 | United Kingdom . |
| 1499706 | 2/1978 | United Kingdom . |
| 1509791 | 5/1978 | United Kingdom . |

OTHER PUBLICATIONS

Encyclopedia of Chemical Technology, vol. 4, 1949.
Hercules Incorporated, Coatings Service Laboratory Report CSL—82A (1974).
W. H. Brady Co. "Self Bonding Name Plates and Decorating Trim", Catalog 200, 1965.
W. H. Brady Co., "Nameplates and Decorative Trim Selector Guide", Bulletin No. 206, 1972.
Hoechst, "Hostaphan Polyester Film, 4500 Series".
Hoechst, "Hostaphan Polyester Film, Laboratory Adhesion Test".
Transilwrap Product Bulletins.
Du Pont Technical Information Manual 1968.
DuPont Product Bulletin.
Dorn Color Card, Inc., Color Card, 1979.
I.C.I. Publication "Melinex" third edition 1979, (Melinex Polyester Film for Every Need).
Hercules publication "Coatings and Inks for Mylar and Saran-Coated Cellophane" CSL-82.
Heffelfinger and Knox, Science and Technology of Polymer Films, Chapter 14 at 590-592 and 618, Polyester Films (John Wiley & Sons 1971).
Encyclopedia of Polymer Science and Technology, Entry for Polyester Films (John Wiley & Sons 1969).
Heffelfinger, A Survey of Film Processing Illustrated with Polyethylene Terephthalate, Polymer Engineering and Science, vol. 18, No. 15 (1978).
Jagrovic, P.S. Coating of polyester films for production of drafting and diazo films. Proc. 3rd. International Conference in Organic Coatings, Science and Technology, Athens 1977, pp. 433-443, (abstract only).
Anon. Better Flexography. Flexogram, 1958, vol. 6, No. 3, 1-3; Printing Abstracts, 1958, vol. 13, No. 7, 481 (abstract only).
Hoechst publication "Hostaphan Polyester Film", Use of Hostaphan 4500 For Solvent-Based Coating Adhesion.
Hoechst publication "Hostaphan Polyester Film, 4400 Series".
Celanese publication "Celanar Polyester Film".
Celanese publication "Celanar Polyester Film", General Properties.
Celanese publication "Celanar Polyester Film, 4500 Series", Product Data Sheet.
Celanese publication "Celanar Polyester Film, Use of 4500 Series Celanar Polyester Film For Solvent-Based Coating and Ink Adhesion".
Transilwrap bulletins (Exhibits 4-5).
Advance Process Supply Co. catalog.

*Primary Examiner*—George F. Lesmes

[57] ABSTRACT

A paint display product is disclosed which comprises a Mylar film base which will provide a high gloss finish to the paint when viewed through the base to the paint.

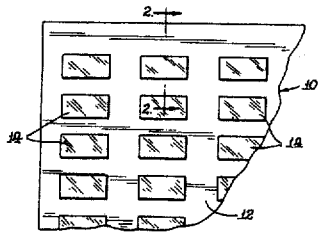

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 to 10 and 12 is confirmed.

Claim 11 is determined to be patentable as amended.

New claims 13–22 are added and determined to be patentable.

11. An automated method for making a color sample display device comprising:

providing a sheet of polyethylene terephthalate having a thickness from about ½ mil to about 7 mils;

[coating] *painting* one surface of said sheet with a paint coating;

coating the painted coating or unpainted surface of said sheet with an adhesive; and adhesively affixing said sheet to a base sheet.

*13. A color display product as recited in claims 5 or 9 wherein the paint coating is continuous over the entire one surface of the film base and the adhesive coating is on the paint coating.*

*14. A color display product as recited in claim 13 wherein the paint coating consists essentially of a paint coating which is applied by a knife over roll coater.*

*15. An automated method as recited in claim 11 wherein the coating with a paint coating is knife over roll coating.*

*16. An automated method as recited in claims 11 or 15 wherein the coating with an adhesive is on the paint coating.*

*17. An automated method as recited in claim 15 wherein the color sample display device is a color card with a plurality of swatches, the swatches comprising the polyethylene terephthalate coated with the paint coating and the paint coating coated with an adhesive, the method further comprising cutting the polyethylene terephthalate coated with the paint coating into a plurality of swatches, coating the paint coating on each of the plurality of swatches with the adhesive coating and affixing the adhesively coated swatches onto the base sheet.*

*18. An automated method as recited in claim 16 wherein the color sample display device is a color card with a plurality of swatches, the swatches comprising the polyethylene terephthalate coated with the paint coating and the paint coating coated with an adhesive, the method further comprising cutting the polyethylene terephthalate coated with the paint coating into a plurality of swatches, coating the paint coating on each of the plurality of swatches with the adhesive coating and affixing the adhesively coated swatches onto the base sheet.*

*19. A color card capable of being produced on an automated apparatus, the card for the display of paint for automobiles, the color card consisting essentially of polyethylene terephthalate film having a thickness of from about ½ mil to about 7 mils, a continuous paint coating on the surface of said film;*

*an adhesive on said paint coating, and*

*a base sheet with said paint coated polyethylene terephthalate adhesively affixed thereto with the adhesive on said paint coating.*

*20. A color card as recited in claim 19 wherein the paint coating consists essentially of a paint coating which is applied by a knife over roll coater.*

*21. A color display product comprising a plurality of color swatches consisting essentially of a polyethylene terephthalate film base with a thickness of from about ½ mil to about 7 mils;*

*a paint coating on one surface of the film base;*

*an adhesive coating; and*

*a mount base, the film base being adhesively affixed to the mounted base with the adhesive coating being on the painted coating,*

*wherein the paint coating is continuous over the entire one surface of the film base and the paint coating consists essentially of a paint coating which is applied by a knife over roll coater.*

*22. A color card as recited in claim 19 wherein the mount base has a plurality of swatches adhesively affixed thereto, the swatches comprising the painted polyethylene terephthalate film.*

* * * * *